US005488457A

United States Patent [19]

Nakagama et al.

[11] Patent Number: 5,488,457

[45] Date of Patent: Jan. 30, 1996

[54] IMAGE FORMING APPARATUS WITH POWER SOURCE CONTROL

[75] Inventors: Kiyohari Nakagama; Mitsugu Nemoto, both of Hachioji, Japan

[73] Assignee: Konica Corporation, Tokyo, Japan

[21] Appl. No.: 288,044

[22] Filed: Aug. 10, 1994

[30] Foreign Application Priority Data

Sep. 1, 1993 [JP] Japan ..... 5-217656

[51] Int. Cl.[6] ..... G03G 21/00

[52] U.S. Cl. ..... 355/203; 355/208; 355/274; 355/285; 355/309

[58] Field of Search ..... 355/203, 204, 355/208, 282, 271–274, 285, 308, 309, 311, 219

[56] References Cited

U.S. PATENT DOCUMENTS

| | | | |
|---|---|---|---|
| 4,134,147 | 1/1979 | Watanabe | 355/272 X |
| 4,610,530 | 9/1986 | Lehmbeck et al. | 355/311 |
| 4,912,515 | 3/1990 | Amemiya et al. | 355/274 |
| 5,119,141 | 6/1992 | Bhagat | 355/274 |
| 5,291,253 | 3/1994 | Kumasaka et al. | 355/208 X |

FOREIGN PATENT DOCUMENTS

| | | |
|---|---|---|
| 53-57042 | 5/1978 | Japan . |
| 55-28081 | 2/1980 | Japan . |

*Primary Examiner*—William J. Royer

*Attorney, Agent, or Firm*—Finnegan, Henderson, Farabow, Garrett & Dunner

[57] ABSTRACT

In an image forming apparatus which adjusts transferring condition according to an output signal from a moisture sensor, a control circuit has an off-time estimation device for estimating a power source interruption period from a surface temperature of a fixing roller and heat radiation elapsed time characteristic of the fixing roller and a time measuring device for measuring the time elapsed after the loading of a sheet feeding cassette. The control circuit further includes a moisture content converter for converting a total elapsed time after loading the sheet feeding cassette and for converting humidity into moisture content data of the transferring sheets. The control circuit controls the output from a high voltage power source of the apparatus, based on the moisture content data.

6 Claims, 5 Drawing Sheets

IMAGE FORMING APPARATUS WITH POWER SOURCE CONTROL

BACKGROUND OF THE INVENTION

The present invention relates to a control method of a high voltage power source which is used for an electrostatic photographing process related to a sheet feeding system of an image forming apparatus into which an electrostatic photographing method is adopted, and specifically to a control method of the high voltage power source corresponding to the moisture content of transfer sheets.

In an image forming apparatus in which an electrostatic photographing method is adopted, the following processes are conducted: a transfer material is superimposed on a toner image which has been electrostatically carried on an image forming body; and a transfer process, in which the toner image is transferred onto the transfer material, is carried out when electric charges are discharged from the rear of the transfer material. In this transfer process, when the moisture content of a transfer sheet is more than 7%, there is a tendency to cause an imperfect transfer phenomenon, in which a toner image remains on the image forming body, and a toner smear phenomenon, in which toner slides on the transfer sheet. The reasons for these phenomena are surface resistance changes of the transfer sheet or resistance changes of the toner itself.

In order to solve these problems, the following technology has been disclosed: the moisture content of a transfer sheet is detected using the correlation between the surface resistance of the transfer sheet and the moisture content of the transfer sheet; and a discharge current of a transferring device is controlled corresponding to the moisture content (refer to Japanese Patent Publication Open to Public Inspection No. 57042/1978(hereinafter referred to as Japanese Patent O. P. I Publication)). In this technology, the moisture content is measured as follows: a pair of conveyance rollers are provided close to a transfer area; when the transfer sheet passes through these pair of conveyance rollers, a predetermined voltage is impressed upon the sheet; and the moisture content is measured by the current which flows through the transfer sheet. Further, the following technology has been disclosed: two closed circuits, which are formed through the transfer sheet sandwiched between a pair of rollers, are provided between a transfer device and a sheet feed cassette; the surface resistance of the transfer sheet is detected by one of two closed circuits; the volume resistance of the transfer sheet is detected by another closed circuit; and a discharge current from the transfer device is controlled according to the result of these measurements (Refer to Japanese Patent Publication O. P. I No. 28081/1980) .

The relationship between the surface resistance of the transfer sheet and the moisture content of the transfer sheet is changed according to a surface processing method of the transfer sheet. Accordingly, the surface processing method, that is, information related to various kinds of transfer sheets, is important.

In the case of the foregoing structure to detect the resistance value of the transfer sheet (Japanese Patent Publication O. P. I Nos. 57042/1978, and 28081/1980) , the transfer process can be carried out satisfactorily to some extent without being affected by the environmental temperature and humidity under which the image forming apparatus has been installed. However, the structure of a sheet feed system from a sheet feed cassette to the transfer device becomes complicated, and thereby, a control by which sheet feed timing is synchronized with voltage impression timing becomes complicated. Further, in some cases, a transfer failure or a sheet separation failure occurs.

The inventors of the present invention have studied a method for controlling the high voltage power source which is used for an electrostatic photographic process related to a sheet feeding system. The method for controlling the high voltage power source includes a method for controlling not only the transfer device but also a neutralizing device.

In this connection, the inventors have investigated the following: a change according to the elapsed time of the moisture content of the transfer sheet under high temperature and high humidity environmental conditions; and a change of the moisture content of the transfer sheet under the condition that the transfer sheet, having the saturated moisture content under the high temperature, high humidity and low temperature, low humidity environmental conditions, is left as it is.

FIG. 6 is a graph showing a change in the elapsed time of the moisture content of the transfer sheet under high temperature and high humidity environmental conditions.

In the experiment carried out by the inventors, a bundle of over 100 transfer sheets was taken from a new package of sheets and was loaded into a sheet feed cassette, and the sheet feed cassette was housed in the image forming apparatus and left undisturbed. The image forming apparatus was installed under high temperature and high humidity environmental conditions. Then, the change in the elapsed time of the moisture content of the transfer sheets loaded in the sheet feed cassette was measured. The moisture content of the transfer sheets is maintained to be approximately 6% under the conditions that the transfer sheets are packed in the package.

In the graph, the ordinate axis shows the moisture content (%), and the abscissa axis shows the elapsed time after the sheet feed cassette has been loaded into the image forming apparatus. The graph shows that there is a time lag between the humidity and the moisture content of the transfer sheet, depending on the loading sequence of the transfer sheets. Accordingly, even if the transfer sheet were the same, appropriate process conditions can not be set only when the humidity, under which the image forming apparatus has been installed, is measured, which is a problem.

In order to assume the moisture content of the transfer sheet from the ambient humidity so that the structure and control of the sheet feeding system can be simplified, it is necessary that the elapsed time after the transfer sheets have been taken out from the package is measured. The time can be measured by counting CPU clock pulses while the power source of the image forming body is turned "on". On the other hand, since the moisture content of the transfer sheet is affected by the humidity even while the power source of the image forming apparatus is turned "off", it is necessary to measure the time during this period. However, in printers or small copiers, an internal timer, which can measure the "off" time of the power source, can not be provided for economical reasons. In spite of these circumstances, in printers and small copiers, the power source is very frequently turned "on" and "off". In view of these circumstances, it is necessary to solve the problem of time measurement during the "off" period of the power source of the apparatus, considering the economical reasons, when the timer is adapted to printers or small copiers.

SUMMARY OF THE INVENTION

In view of the foregoing, the first object of the present invention is to provide an image forming apparatus in which a control method of a high voltage power source corresponding to a moisture content of transfer sheets is adopted without complicating the structure and control of a sheet feeding system.

The second object of the present invention is to provide an image forming apparatus in which a control method of a high voltage power source is adopted, which corresponds to the moisture content of transfer sheets and is appropriate for a printer or a small copier.

The third object of the present invention is to provide an image forming apparatus in which a control method of a high voltage power source which is not affected by the time lag of moisture content due to the stacking sequence of transfer sheets.

The fourth object of the present invention is to provide an image forming apparatus in which a control method of a high voltage power source, in which appropriate process conditions can be obtained under any moisture absorption conditions or moisture radiation conditions of transfer sheets, is adopted.

The first embodiment of the present invention is structured as follows: an image forming apparatus which adjusts process conditions related to a sheet feeding system according to an output signal from a moisture sensor comprises an off-time estimation means for estimating a power source interruption period from a surface temperature of a fixing roller and heat radiation elapsed time characteristics of the fixing roller; time measuring means for measuring the time elapsed after the loading of a sheet feed cassette; moisture content conversion means for converting a total elapsed time after the loading of the sheet feed cassette, and humidity into moisture content of the transfer sheets; and a control circuit for controlling the output from the high voltage power source.

The second embodiment of the present invention is structured as follows: the image forming apparatus is provided with memory means, other than the control circuit, for writing humidity data of the sheets and temperature data of the surface of the fixing roller at the time of the power source interruption, and the total elapsed time after loading of the sheet feed cassette.

The third embodiment of the present invention is structured as follows: the control circuit comprises, other than the foregoing means loading sequence detection means for detecting the loading sequence of the transfer sheets loaded into the sheet feed cassette, at the time of power source activation; and time-lag correction means for correcting any time-lag between the humidity and the moisture content caused by the the loading sequence of the transfer sheets.

The fourth embodiment of the present invention is structured as follows: the control circuit is provided with, other than the foregoing means; a sheet condition detection means for detecting whether the transfer sheets are in a condition of moisture absorption or in a condition of moisture radiation, from humidity data at the time of power source activation and humidity data at the time of power source interruption; a moisture content conversion means when the transfer sheets are in a condition of moisture absorption; and a moisture conversion means when the transfer sheets are in a condition of moisture radiation.

Heat radiation elapsed time characteristics counted from the temperature of 190° C. which is in an "off" time measuring method adopted in the present invention will be described below.

FIG. 5 is a graph showing heat radiation elapsed time characteristics of the fixing roller of the image forming apparatus of this embodiment.

The heat radiation elapsed time characteristics of the surface temperature of the fixing roller can be approximately expressed as follows:

$$T(\tau)=K\exp(-\tau/\eta)+C \quad (1)$$

Where, the temperature in the apparatus is assumed to be constant, without depending on the environmental temperature; and the elapsed time temperature=T, the initial temperature= 190° C. the proportional constant=K, the temperature in the apparatus=25° C. the time constant=η, the off-time=τ, an unknown constant=C.

Since T(0)=K+C=190 and T(∞)=C=25° C., the following can be obtained.

K=T(0)−T(∞)=190−25=165. That is, $$T(\eta)=165\exp(-\tau/\eta)+25 \quad (1)'$$

Next, τ/η=1, that is, when exp (−τ/η)=0.368, and T(τ) =86(° C.) in the graph showing heat radiation elapsed time characteristics, then τ may be; τ=10.

Here, when considering the influence of the temperature outside the apparatus, the equation (1)' will be as follows.

$$T=165\exp(-\tau/10)+25+\alpha \quad (2)$$

Where, α is a correction value showing the influence such as air flow in the vicinity of the temperature rising portion, and temperature difference between the apparatus main body and ambient air, and, for example, α can be approximated as follows.

$\alpha=(T_R-25)(1-\exp(-\tau/20))$, $T_R$: the room temperature

Then, when T(10) and T(20) are calculated with respect to room temperatures $T_R$=10, 20, 30° C. which are assumed as normal temperatures, the time estimation error ΔT is respectively obtained as follows:

ΔT (10)≦±1 minute,

ΔT (20)≦±2 minute.

Therefore, errors caused when an off-time is estimated from the temperature of the temperature rising portion, are within approximately ±10% , which is satisfactorily small. Accordingly, time measuring can be carried out with a satisfactory accuracy.

DETAILED DESCRIPTION OF THE PREFERRED EMBODIMENTS

Figure 1:
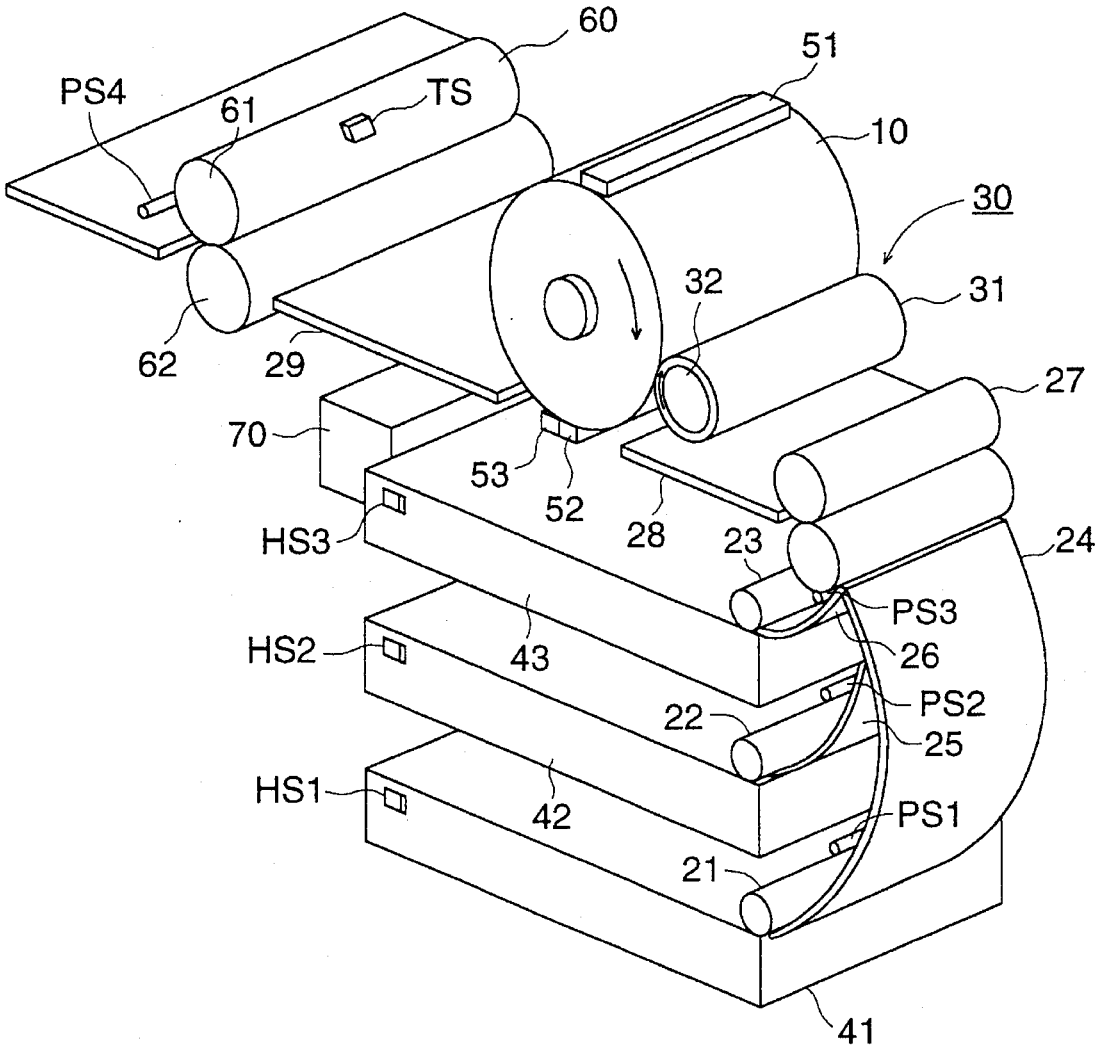
FIG. 1 is a perspective view showing the outline structure of an example of an image forming apparatus in the present invention.

FIG. 1 is a perspective view showing an outline structure of one example of an image forming apparatus in the present invention.

In FIG. 1, an image forming body 10 is a drum-shaped photoreceptor which rotates in the arrowed direction and is formed of a negatively charged coating type OPC (hereinafter, called a photoreceptor drum). The photoreceptor drum 10 comprises a conductive base material and a photoreceptor layer for covering the surface of the base material, in which the film thickness is 15 to 30 μm, the dielectric constant is 2.0 to 5.0, and the conductive base material is grounded.

A process means comprising a charger 51, an exposure section (not shown in the drawing) onto which image light sent from a writing unit is projected, developing unit 30, a transfer unit 52, a separating unit 53, and a cleaning unit (not shown in the drawing), is provided around the photoreceptor drum 10, and a sheet feeding means comprising sheet feed cassettes 41, 42 and 43, the first sheet feed rollers 21, 22, and 23, sheet feed guides 24, 25, 26, and 28, 29, the second sheet feed roller 27, the foregoing transfer unit 52, separating unit 53, and a fixing unit 60, is also provided around the photoreceptor drum 10. As a characteristic structure of this example, each member of the sheet feeding system will be described in detail below.

Moisture sensors HS1, HS2 and HS3 are provided on a side wall of the sheet feed cassettes 41, 42 and 43 as shown in the drawing. Moisture sensors HS1, HS2 and HS3 will be described in detail later.

Sheet feed sensors PS1, PS2 and PS3 are respectively provided at predetermined distances from the first sheet feed rollers 21, 22, 23 on sheet feed guides 24, 25, 26. Passage of transfer sheets $P_{1n}$ is detected by these sensors and the loading sequence of transfer sheets is also detected by these sensors. This loading sequence detection method will be described later.

As is commonly known, the second sheet feed roller 27 conducts a registering operation of a toner image held on the photoreceptor drum 10, and transfer sheets $P_{1n}$.

The transfer unit 52 conducts the following operation, as is commonly known: transfer sheets $P_{1n}$ are superimposed on the toner image electrostatically held on the photoreceptor drum 10; discharging is conducted from the rear of the transfer sheets; and then, the toner image is transferred onto the transfer sheet $P_{1n}$. Although a scorotron discharger having a plurality of discharging wires which are connected to a high voltage power source 70, and controlling electrode wires which control discharging conditions of the discharging wires, is preferable for uniformly charging the transfer sheet, it is not limited to the above-described discharger. However, a corotron charger or a charging roller which can electrostatically transfer the toner image onto the transfer sheets $P_{1n}$, $P_{2n}$, and $P_{3n}$, may be used for this purpose.

As is widely known, the separating unit 53 discharges the transfer sheets $P_{1n}$ which are electrostatically attracted onto the photoreceptor drum 110, and separates the transfer sheets from the photoreceptor drum 110. A scorotron charger, a corotron charger, or a charging roller can be used for the above-described purpose.

As is widely known, the fixing unit 60 applies heat, or heat and pressure on the transfer sheets $P_{1n}$ on which the toner image is held, and fixes the toner image on the transfer sheets $P_{1n}$. In the fixing unit 60, an upper roller 61 is a heating roller in which a electric heater (not shown) is housed, and a lower roller 62 is a pressing roller on which an elastic layer of rubber or the like, is formed on the surface of a metallic cylinder made of aluminum or the like, and the upper roller 61 is pressed by the roller. A temperature sensor TS is provided on the surface of the upper roller 61. The temperature sensor TS and the high voltage power source 70 will be described in detail later.

The developing unit 30 is loaded with a two-component developer (hereinafter, called developer). After the developer has been stirred with a stirring screw, the developer is attracted to the outer periphery of a developing sleeve 31 rotating around a magnet roller 32, and forms a magnetic brush of the developer. A predetermined bias voltage is impressed upon the developing sleeve 31, and development is conducted in a developing area opposed to the photoreceptor drum 10.

The charger 51 uniformly charges the photoreceptor drum 10 to a predetermined voltage by a well-known scorotron charger before a latent image forming process, and gradation repeatability is adjusted so that photographic fogging can be prevented.

A cleaning unit (not shown) scrapes off toner and dust attracted onto the photoreceptor drum surface when a blade is contacted with the photoreceptor drum surface, and is prepared for the next image forming process.

Figure 2:
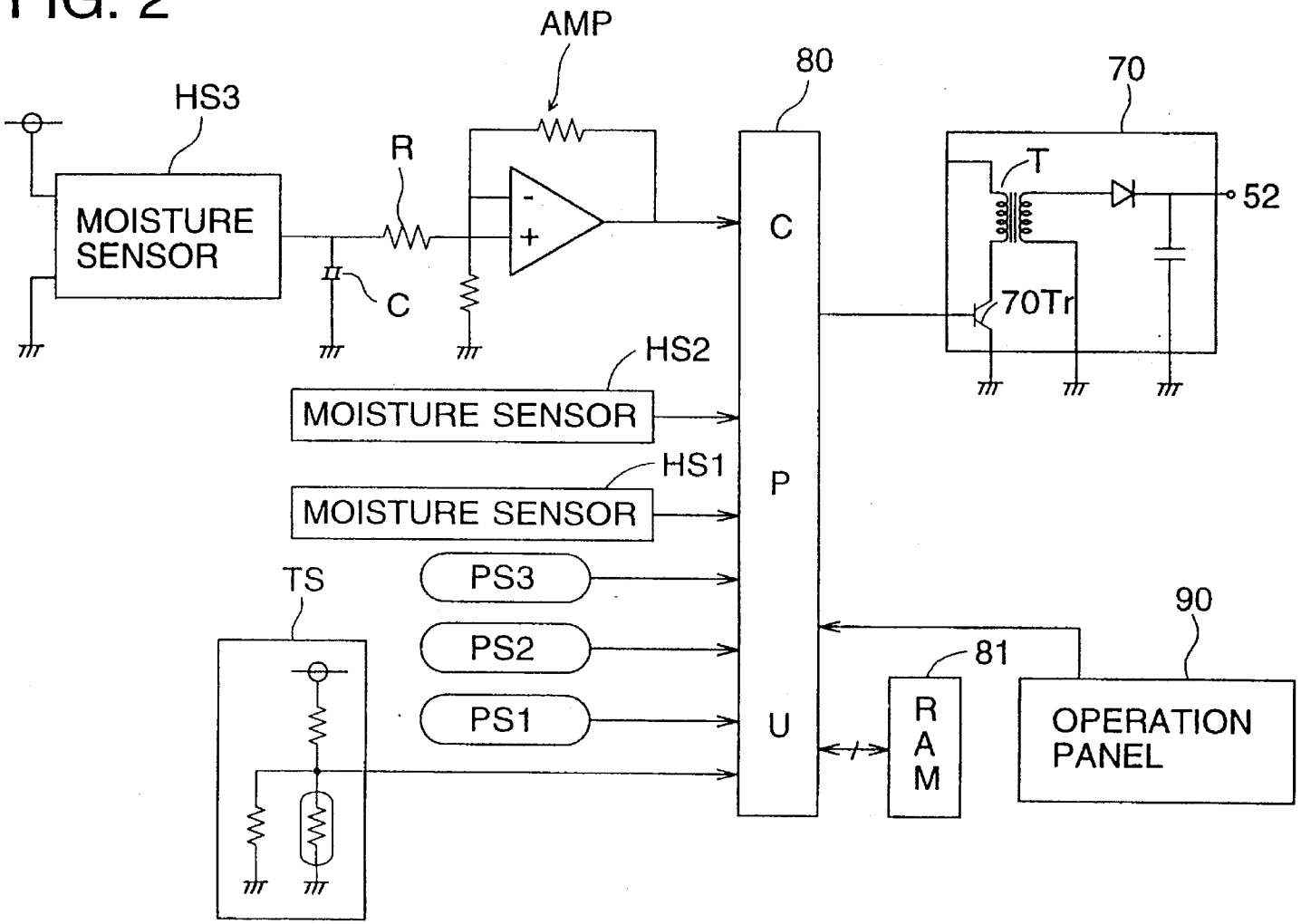
FIG. 2 is a block diagram showing a high voltage power source control circuit of the image forming apparatus in the present invention.

Referring to FIG. 2 and FIG. 1, the structure of a control circuit of the high voltage power source 70 in the image forming apparatus of this example will be described below.

FIG. 2 is a block diagram showing the high voltage power source control circuit of the image forming apparatus in this example.

The high voltage power source control circuit in this example comprises a CPU 80, a non-volatile RAM 81, moisture sensors HS1, HS2, HS3, sheet feed sensors PS1, PS2, PS3, a temperature sensor TS and the high voltage power source 70.

The CPU 80 corresponds to a control circuit, which carries out an image forming program for controlling the whole electrostatic photographic process ranging from a pre-charging process, an image exposure process, a developing process, a transfer separation process, a fixing process to a delivery process. The data structure necessary for control operations in the transfer/separation process, (which will be described later), will be explained below.

Time counters TKM, TK1, TK2, TK3 for counting operation clocks (not shown) and a jam counter $TK_{J1}$(not shown) are housed in the CPU 80. The following are provided in a ROM housed in the CPU 80: moisture memories HSM1, HSM2, HSM3 (not shown) into which humidity data are written, in which the output signals from moisture sensors HS1, HS2, HS3 are decoded into 256 gradations; a loading sequence detection means PSM (not shown) for carrying out increments of sheet feeding signals sent from sheet feeding sensors PS1, PS2, PS3; a moisture absorption table TBL1 into which correction data, to be used when the transfer sheets $P_{1n}$, $P_{2n}$, $P_{3n}$ are under conditions of moisture absorption, is written; a moisture radiation table TBL2 into which correction data, to be used when the transfer sheets $P_{1n}$, $P_{2n}$, $P_{3n}$ are under conditions of moisture radiation, is written; and sheet condition bins $PSB_{an}$, $PSB_{bn}$, $PSB_{cn}$ into which correction data are written in the manner that the correction data can be shifted, wherein moisture content corresponding to the loading sequence of transfer sheets $P_{1n}$, $P_{2n}$, $P_{3n}$ are converted using the correction data. Further, a heat radiation elapsed time characteristic table TBL3 depending on the above-described heat elapsed time characteristics is written in the ROM housed in the CPU 80.

Time counters TKM, TK1, TK2, TK3 carry out increment of operating clocks of the CPU 80, and count the elapsed time from power source activation. The time counter TKM is reset to zero when the power source is turned off. Time counters TK1, TK2, TK3 are respectively reset when sheet feed cassettes 41, 42, 43 are taken out, and start counting operations when the sheet feed cassettes 41, 42, 43 are loaded. Time counters TK1, TK2, TK3 correspond to a time counting means. The time counter TK1 corresponds to the sheet feed cassette 41, the time counter TK2 corresponds to the sheet feed cassette 42, and the time counter TK3 corresponds to the sheet feed cassette 43. The detailed explanation of operations of time counters TKM, TK1, TK2, TK3 (S11, S12 in FIG. 4) will be described later.

Output from moisture sensors HS1, HS2, HS3 is written into moisture memories HSM1, HSM2, HSM3 in real time. Here, humidity value at the time of the power source deactivation is important, and this value is written into a non-volatile RAM 81 which is provided outside the apparatus. The detail of the above-described operations will be described later in the explanation of operations (S15 in FIG. 4).

In the loading sequence detection means PSM1, PSM2, PSM3, sheet feed sensors PS1, PS2, PS3 are used for detecting the loading sequence of transfer sheets $P_{1n}$, $P_{2n}$, $P_{3n}$ stored in the sheet feed cassette 41, 42, 43, and these sensors are used for counting the number of sheets supplied from the uppermost layer at the time of power source activation.

Using Table 1 and Table 2, the moisture absorption table TBL1 and the moisture radiation table TBL2 each corresponding to a moisture content conversion means and a time lag correction means, will be described below.

As described above, when the transfer sheets are left as they are under high temperature and high humidity, and the low temperature and low humidity conditions, and are allowed to have saturated moisture content, and after that, these transfer sheets are left as they are under normal temperature and normal humidity, the transfer sheets, having a saturated moisture content under high temperature and high humidity conditions, are under moisture radiation conditions, under which the moisture content is radiated into the atmosphere. On the other hand, the transfer sheets having a saturated moisture content under low temperature and low humidity conditions, are under moisture absorption conditions, under which the moisture content is absorbed.

A sheet condition detection means in this example is realized by a program (S6 shown in FIG. 3) which is started in the CPU 80, and from the inventor's experiments, humidity of 74% is defined as the boundary between the moisture absorption condition and the moisture radiation condition. Accordingly, in this example, when humidity changes from more than 74% to less than 74%, the transfer sheets $P_{1n, P2n}$, $P_{3n}$ are considered to be under moisture radiation conditions, and the transfer current is corrected by the moisture radiation table shown in the table 2. When the humidity changes from less than 74% to more than 74%, the transfer sheets $P_{1n}$, $P_{2n}$, $P_{3n}$ are considered to be under moisture absorption conditions, and the transfer current is corrected by the moisture absorption table. When there are different kinds of transfer sheets, it is of course that the humidity, which defines the moisture absorption condition and the moisture radiation condition, changes.

[TABLE 1]

| Elapsed time (min.) | Moisture absorption table (μA) Loading sequence 2nd | 5th | 10th | 20th | over 20th |
|---|---|---|---|---|---|
| 5 | 10 | 5 | 0 | 0 | 0 |
| 60 | 10 | 5 | 5 | 0 | 0 |
| 180 | 10 | 5 | 5 | 5 | 5 |
| Over 180 | 10 | 10 | 10 | 5 | 5 |

In Table 1, the time shows the elapsed time just after bundles of transfer sheets $P_{1n}$, $P_{2n}$, $P_{3n}$ are taken from the sheet package and are loaded into the sheet feed cassettes. The loading sequence means the sequence of the loaded sheets when bundles of the transfer sheets $P_{1n}$, $P_{2n}$, $P_{3n}$ are taken out from the sheet package and are loaded into the sheet feed cassettes. This information structures a time lag correction means, and is necessary because more time lag occurs in the time lag caused between the humidity and the moisture content of the transfer sheet, depending on the loading sequence. Values in the table show corrected values (μA) from "the transfer current values under the normal temperature and normal humidity–180(μA)".

[TABLE 2]

| Elapsed time (min.) | Moisture radiation Table (μA) Loading sequence 10th | over 10th |
|---|---|---|
| 5 | 10 | 5 |
| 10 | 5 | 0 |
| Over 10 | 0 | 0 |

In Table 2, the time and the loading sequence are the same as those in the table 1. Also the values in Table 2 shows the corrected values (μA) from "the transfer current values under the normal temperature and normal humidity–180(μA)".

In sheet condition bins $PSB_{an}$, $PSB_{bn}$, $PSB_{cn}$, 21 memory areas $PSB_1$ through $PSB_{21}$ are provided corresponding to the loading sequence of the sheets from the uppermost layer. Correction values from the correction tables, which are different depending on whether the transfer sheets $P_{1n}$, $P_{2n}$, $P_{3n}$ are under the moisture radiation condition or moisture absorption condition, are written in the memory areas. The correction data is shifted sequentially in the direction of descending order at every time when only one of transfer sheets $P_{1n}$, $P_{2n}$, $P_{3n}$, is fed. Due to the foregoing, because the correction value corrects the time lag between the humidity and the change of the moisture content of the the transfer sheets $P_{1n}$, $P_{2n}$, $P_{3n}$, as stated above, and also includes the time lag depending on the loading sequence of the sheet, the time lag between the humidity and the moisture content caused by the loading sequence of the the transfer sheets $P_{1n}$, $P_{2n}$, $P_{3n}$, can be positively corrected. Here, the direction of descending order means the direction from $PSB_{21}$ to $PSB_1$. Sometimes, when the transfer sheets $P_{1n}$, $P_{2n}$, $P_{3n}$ are jammed, shifting is not conducted.

[TABLE 3]

| Elapsed time | Operation condition of sheet condition bin PSBn (μA) | | | | | | | | | | |
|---|---|---|---|---|---|---|---|---|---|---|---|
| | Sheet condition bins | | | | | | | | | | |
| (min.) | $PSB_1$ | $PSB_2$ | $PSB_3$ | $PSB_4$ | $PSB_5$ | $PSB_6$ | ... $PSB_{10}$ | $PSB_{11}$ | ... $PSB_{16}$ | ... $PSB_{20}$ | $PSB_{21}$ |
| 0 | 0 | 0 | 0 | 0 | 0 | 0 | 0 | 0 | 0 | 0 | 0 |
| 5 | 10 | 10 | 5 | 5 | 5 | 0 | 0 | 0 | 0 | 0 | 0 |
| ① | 10 | 5 | 5 | 5 | 0 | 0 | 0 | 0 | 0 | 0 | 0 |
| 10 | 10 | 10 | 5 | 5 | 5 | 5 | 5 | 0 | 0 | 0 | 0 |
| Over 180 | 10 | 10 | 10 | 10 | 10 | 10 | 10 | 5 | 5 | 5 | 5 |
| ⑨ | 10 | 5 | 5 | 5 | 5 | 5 | 5 | 5 | 5 | 5 | 5 |

In Table 3, "elapsed time" shows the elapsed time just after the package of the bundle of transfer sheets $P_{1n}$, $P_{2n}$, $P_{3n}$ has been opened and the transfer sheets have been loaded into the sheet feed cassettes 41, 42, 43. $PSB_n$ (n=1 to 21) is a sheet condition bin as stated above. The values in the Tables are correction values (μA), and are naturally written into the memory area of the sheet condition bins $PSB_{an}$, $PSB_{bn}$, $PSB_{cn}$ as codes. In the table 3, the sheet condition bins are represented by $PSB_n$.

The heat radiation elapsed time characteristic table TBL3 corresponds to the interruption time estimation means, and the left-alone time τ corresponds to the individual temperatures. Values calculated from the equation expressing the relationship between the heat radiation elapsed time characteristics and the left-alone time, are shown in Table 4 as heat radiation elapsed time characteristic tables 1 and 2. In Table 4, temperatures corresponding to the time shorter than 80 minutes are shown. However, since the time for which the upper roller 61 reaches the normal temperature is about 3 hours, the off-time can be calculated to 3 hours. Since the left-alone time τ, which can be calculated, depends on the heat capacity of the upper roller 61, the off-time τ can be calculated for a longer period of time when the heat capacity of the upper roller 61 is increased. The off-time τ is converted depending on the table TBL3.

Although the heat radiation elapsed time characteristic table TLB3 is provided in this example, the present invention is not limited to this example. It is assumed that the same results can be obtained by the calculation program.

[TABLE 4]

| Heat radiation elapsed time characteristic table | |
|---|---|
| Off-time τ (min.) | Temperature (°C.) |
| 0 | 195 |
| 2 | 187 |
| 3 | 185 |
| 4 | 179 |
| 5 | 174 |
| 6 | 169 |
| 7 | 164 |
| 8 | 165 |
| 9 | 156 |
| 10 | 152 |
| 11 | 148 |
| 12 | 143 |
| 13 | 141 |
| 14 | 138 |
| 15 | 134 |
| 16 | 131 |
| 17 | 128 |
| 18 | 125 |

[TABLE 4]-continued

| Heat radiation elapsed time characteristic table | |
|---|---|
| Off-time τ (min.) | Temperature (°C.) |
| 19 | 122 |
| 20 | 120 |
| 21 | 117 |
| 22 | 115 |
| 23 | 112 |
| 24 | 110 |
| 25 | 107 |
| 26 | 105 |
| 27 | 103 |
| 28 | 102 |
| 29 | 100 |
| 30 | 98 |
| 31 | 96 |
| 32 | 94 |
| 33 | 93 |
| 34 | 91 |
| 35 | 90 |
| 36 | 88 |
| 37 | 86 |
| 38 | 85 |
| 39 | 83 |
| 40 | 82 |
| 41 | 81 |
| 42 | 80 |
| 43 | 79 |
| 44 | 77 |
| 45 | 76 |
| 46 | 75 |
| 47 | 74 |
| 48 | 73 |
| 49 | 72 |
| 50 | 71 |
| 51 | 70 |
| 52 | 69 |
| 53 | 68 |
| 55 | 67 |
| 57 | 65 |
| 58 | 64 |
| 60 | 63 |
| 61 | 62 |
| 64 | 61 |
| 65 | 59 |
| 67 | 59 |
| 68 | 57 |
| 73 | 55 |
| 74 | 54 |
| 80 | 52 |

For example, moisture sensors HS1, HS2, HS3 output the max. 1.0 V corresponding to the humidity. These sensors are connected to an amplifier AMP which amplifies the input through a capacitor C and an input resistor R for removing noises by about 4.5 times so that the input approaches to the driving voltage of 5 V. Moisture sensors HS1, HS2, HS3 are provided on the side walls of the sheet feed cassettes 41, 42, and 43, and detect the humidity in the vicinity of sheet feed cassettes 41,42, and 43. Here, although the moisture sensors are provided on the sheet feed cassettes 41, 42, 43, the humidity under the environmental condition under which the image forming apparatus is installed, may be detected. Accordingly, of course, a plurality of moisture sensors are not necessary, and further, the moisture sensor may be provided on a circuit board.

The non-volatile RAM 81 corresponds to the memory means. Data to be held even when the power source is turned off are written in the non-volatile RAM 81. Data is read out by initializing which is conducted at the time of power source activation. In this example, counted values of the time counters TK1, TK2, TK3 at the time of the power source deactivation, and moisture data sent from the moisture sensors are written in the non-volatile memory.

For example, sheet feed sensors PS1, PS2, PS3 detect the trailing edge of the transfer sheets $P_{1n}$, $P_{2n}$, $P_{3n}$, when a light projection portion and light receiving portion are provided. Here, these sensors are mainly used for recognizing the loading sequence of sheets. However, it is possible for these sensors to also be used for sheet feed sensors for jamming detection.

For example, the temperature sensor TS is composed of a thermistor shown in FIG. 2. The sensor TS detects the surface temperature of the upper roller 61 which includes an electric heater, and outputs the output voltage of max. 5 V. The off-time is calculated from the heat radiation elapsed time characteristics using this temperature sensor. However, the sensor, which is used for controlling the fixing temperature to a predetermined value, may be applied to the temperature sensor TS, or the temperature sensor TS may be provided independently.

A sheet delivery sensor PS4 detects the trailing edge of the transfer sheets $P_{1n}$, $P_{2n}$, $P_{3n}$, which have been delivered from the fixing unit 60.

The high voltage power source 70 impresses a voltage of about 800 V onto discharge wires of the transfer unit 52, the separation unit 53 and the charger 51 when a base current of a transistor 70$T_r$ is controlled so that a secondary voltage of a transformer T is controlled. The base current of the transistor 70$T_r$ is controlled by the CPU 80. A control method of this high voltage power source 70 will be described in detail later. In this example, the impressed voltage onto the transfer unit 52 is explained. However, the present invention is not limited to this voltage, and the impressed voltage onto the separation unit may be controlled.

Figure 3:
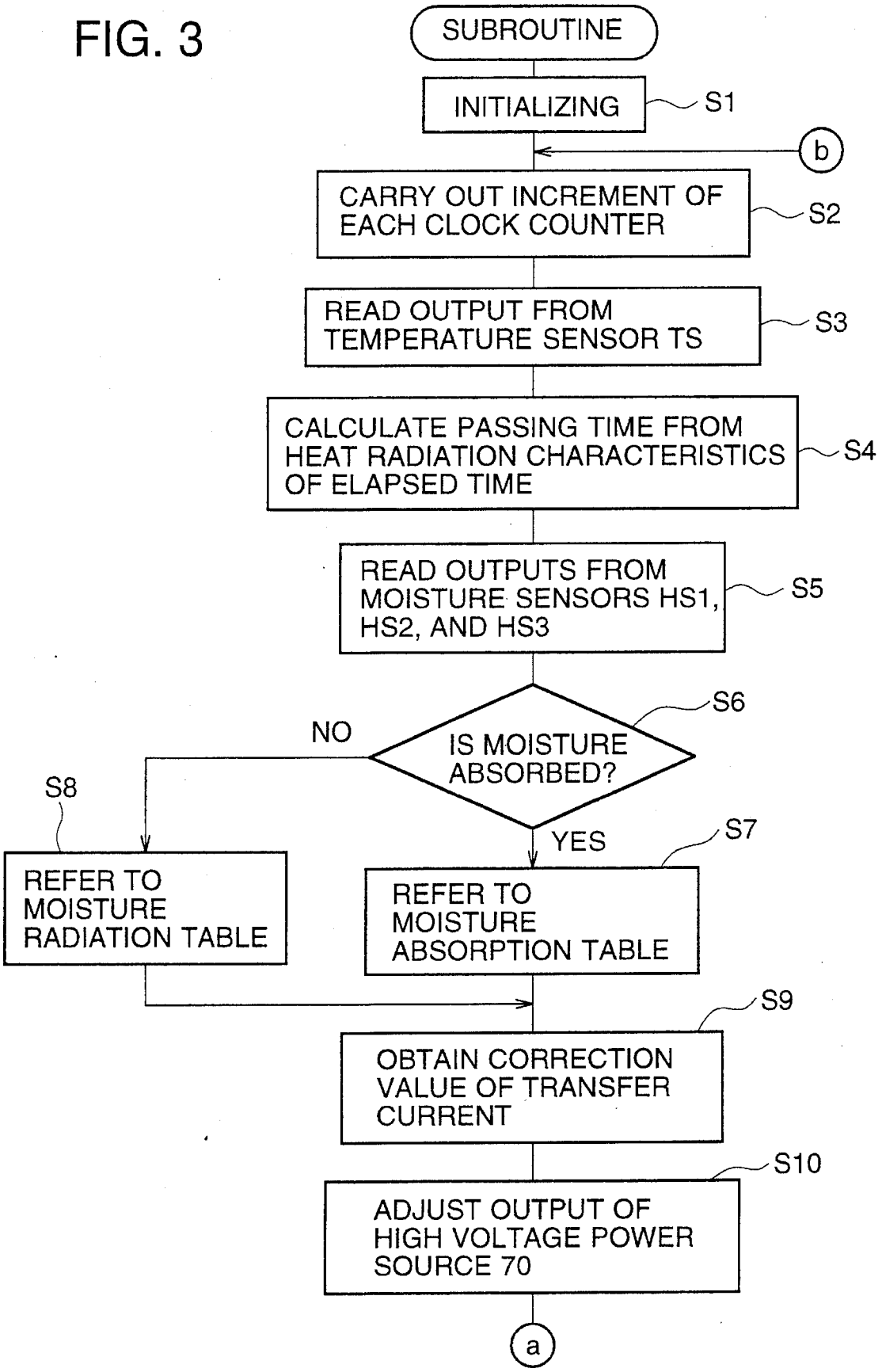
FIG. 3 is a flow chart showing a portion of an operation in the high voltage power source control circuit.
Figure 4:
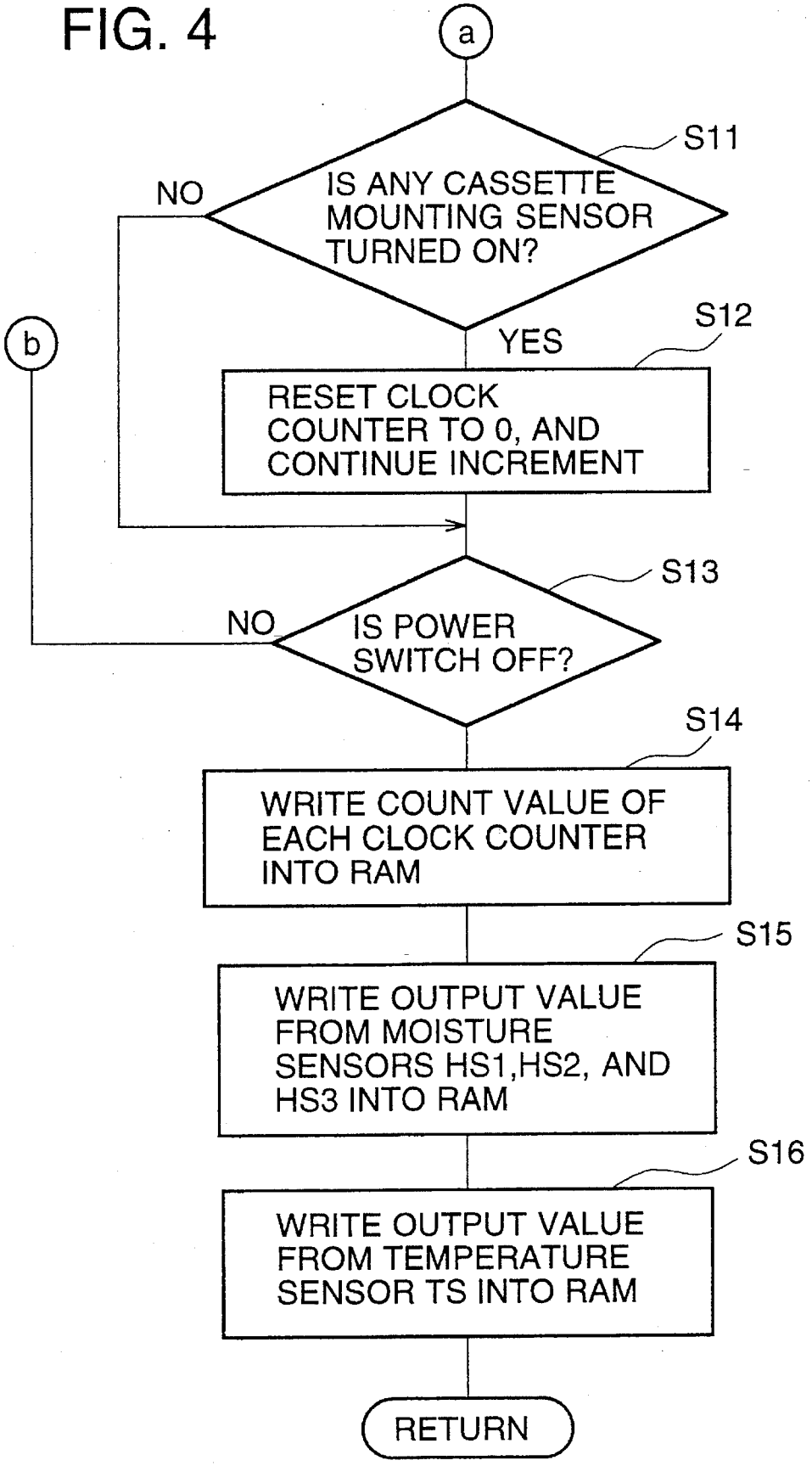
FIG. 4 is a flow chart showing another portion of the operation in the high voltage power source control circuit.
Figure 5:
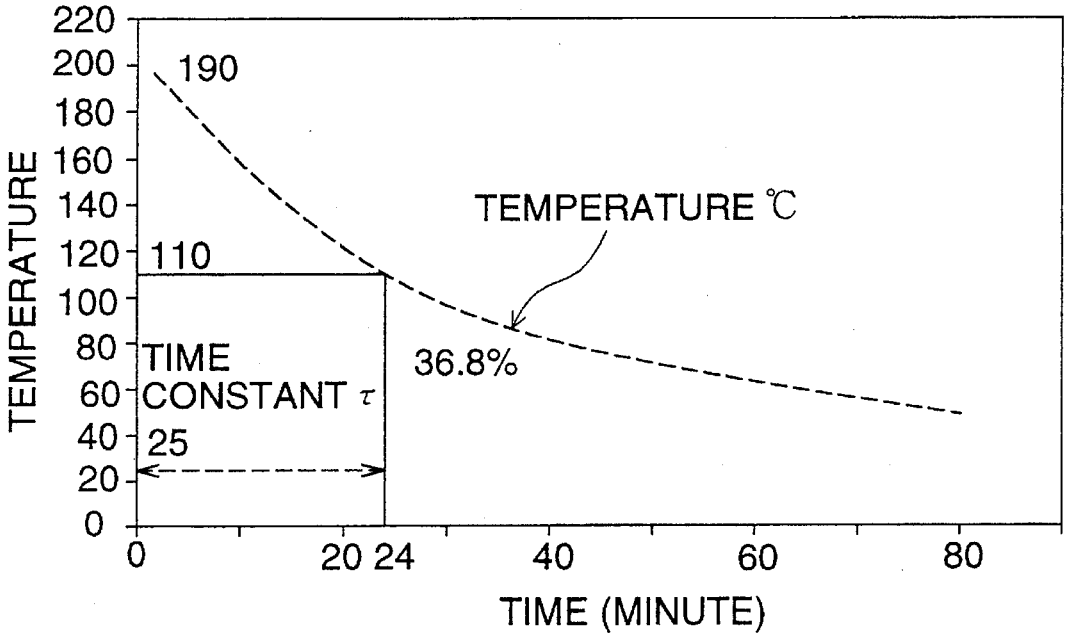
FIG. 5 is a graph showing heat radiation elapsed time characteristics in an fixing apparatus in the image forming apparatus of this invention.
Figure 6:
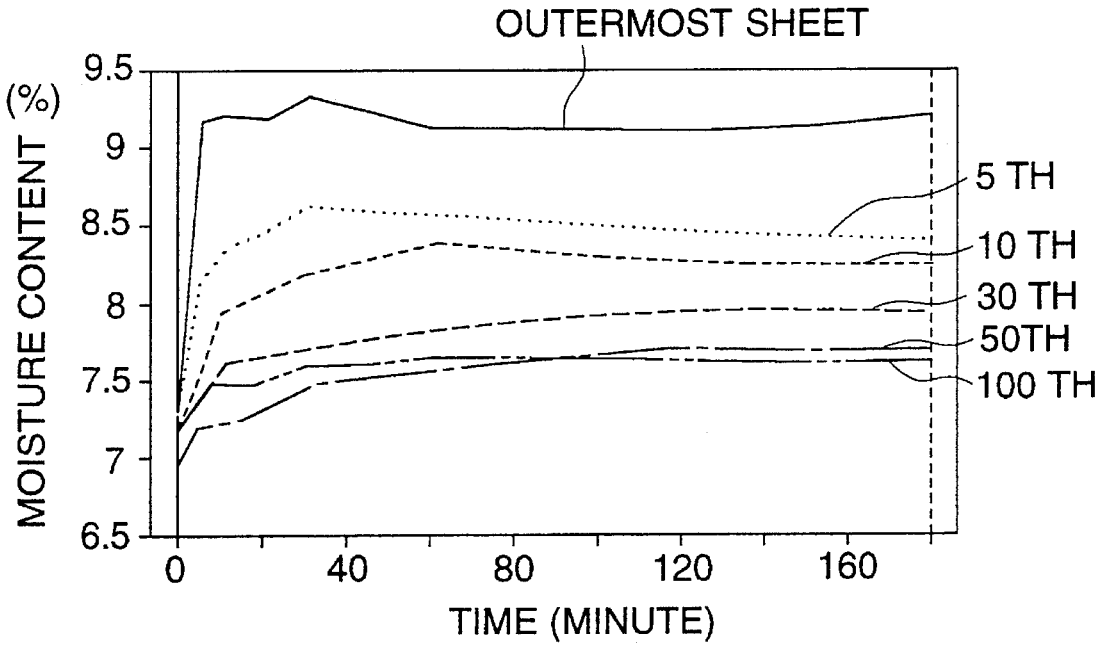
FIG. 6 is a graph showing the time lag between a moisture content and humidity of the transfer sheets.

Referring to FIGS. 3 and 4, control operations of the power source control circuit in this example will be described below.

FIG. 3 is a flow chart showing one portion of the operations in the high voltage power source control circuit. FIG. 4 is a flow chart showing another portion of the operations in the high voltage power source control circuit.

When the power source of the image forming apparatus is turned on by the operator, the CPU 80 installs an image forming process program from a ROM (not shown) which is housed in the CPU 80; the CPU reads in each kind of data such as humidity data, temperature data, elapsed time data $T_1$, $T_2$, $T_3$, and initializing processing is conducted (S1). Due to the foregoing, the time counters TKM, TK1, TK2, TK3 carry out increments of the operation clocks (S2). After that, a main routine starts the high voltage power source control program.

The high voltage power source control program consists of an off-time calculation routine and a sheet condition bin $PSB_{an}$, $PSB_{bn}$, $PSB_{cn}$, determination routine.

In the high voltage power source control program, the CPU 80 reads in the output voltage from the temperature sensor TS, and decodes it in 256 gradations in order to obtain temperature data (S3). The CPU 80 can obtain the off-time $\tau$ elapsed from the time of the power source deactivation to the time of the power source activation from the heat radiation elapsed time table TBL3 according to the LSB of temperature data (S4). As described above, the off-time $\tau$ can be estimated even when a timer having a back-up power source is not provided in the apparatus. Accordingly, when the present invention is applied to a printer, or a smaller copier, a counting operation can be carried out during the power source deactivation. As described above, the routines from step 3 to step 4 are the routine to obtain the off-time $\tau$ during which the main power source is turned off.

The CPU 80 writes the humidity data, which is obtained after the output voltage from the moisture sensors HS1, HS2, HS3 have been read and decoded into 256 gradation by A/D conversion, into the moisture memories HSM1, HSM2, HSM3 (S5). The CPU 80 reads in three pieces of humidity data from the non-volatile RAM 81, and judges whether the transfer sheets $P_{1n}$, $P_{2n}$, $P_{3n}$, are under the moisture absorption condition, or under the moisture radiation condition. As will be described later, the humidity data read in from the non-volatile RAM 81 is the data which has been written in after-processing at the time of the preceding power source deactivation, which will be sometimes called the preceding humidity data. Conditions of the transfer sheets $P_{1n}$, $P_{2n}$, $P_{3n}$, are judged specifically from the preceding humidity data and the humidity data. That is, when the humidity changes from more than 74% to less than 74% , the transfer sheet $P_{2n}$, $P_{3n}$ are judged to be under the moisture radiation condition. When the humidity changes from less than 74% to more than 74% , the transfer sheets $P_{1n}$, $P_{2n}$, $P_{3n}$, are judged to be under the moisture absorption condition. (S6) This step, step 6, corresponds to the sheet condition detection means. As described above, the moisture content considering the moisture absorption condition and moisture radiation condition during the off-time can be estimated in this example. The sheet condition detection means is realized by software in this example. However, it is not limited to the software, but, of course, the sheet condition detection means can also be realized by hardware.

Accordingly, when the transfer sheets $P_{1n}$, $P_{2n}$, $P_{3n}$, are judged to be under the moisture absorption condition, the CPU 80 refers to the moisture absorption table shown in Table 1(S7), and writes in the content of the sheet condition bins $PSB_{an}$, $PSB_{bn}$, and $PSB_{cn}$(S9). On the other hand, when the transfer sheets $P_{1n}$, $P_{2n}$, $P_{3n}$, are judged to be under the moisture radiation condition, the CPU 80 refers to the moisture radiation table shown in Table 2(S8), and writes in the content of the sheet condition bins $PSB_{an}$, $PSB_{bn}$, and $PSB_{cn}$(S9). A sheet condition bin $PSB_{an}$, $PSB_{bn}$, $PSB_{cn}$ determination routine is carried out by steps 5 through 9.

For ease of explanation, it is assumed that the sheet feed cassettes 41, 42, 43 are loaded at approximately the same time into the image forming apparatus.

In this example, the following are assumed: the off-time $\tau$ is calculated to be 2 minutes in the off-time calculation routine (S3, S4); and the time added by the elapsed time data $T_1$, $T_2$, $T_3$, which are written in the non-volatile RAM 81 in the after-processing, explained later, is 5 minutes. Further, step 10 will be explained below under the following assumption: the transfer sheets are judged to be under the moisture absorption condition by the correction value determination routine; and the contents of the sheet condition bins $PSB_{an}$, $PSB_{bn}$, $PSB_{cn}$ are determined by the moisture absorption table TBL1 shown in Table 1, and are written in the memory areas as shown in Table 3.

The OR is made by the logical content of the table of the preceding sheet condition bin and that of the table showing the sheet humidity condition, and the table of the present sheet condition bin is made. In the case where the sheets are used and the stacking sequence is changed, the present sheet condition bin is shifted to the left by the number of used sheets, and the sheet condition bin is made to correspond to the number of used sheets. The result is substituted into the memory for the preceding sheet condition bin and the apparatus is ready for the next copying operation.

When the size of the transfer sheet, the number of sheets to be copied, and copy magnification are designated by the operation of panel 90 (refer to FIG. 2) and successively a copy start command is sent to the CPU 80, then the photoreceptor drum 10 starts its rotation in the arrowed direction under the control of the CPU 80 (refer to FIG. 1). The CPU 80 supplies a predetermined output voltage from the high voltage power source 70 to the charger 51. Thereby, the charger 51 starts the discharging operation and the image forming area of the photoreceptor drum 10 is uniformly charged. An electrostatic latent image is formed in the image forming area when, for example, laser beams are irradiated onto the photoreceptor drum 10 from the writing unit. A two-component developer (hereinafter, simply called developer) is loaded in the developing unit. Next, the developer is stirred by a stirring screw (not shown in the drawing). After that, the stirred developer is attracted to the outer periphery of a developing sleeve 31 which is rotated outside a magnet roller 32, and forms a magnet brush of the developer. A predetermined bias voltage is impressed upon the developing sleeve 31 and then the reversal development is conducted in a developing area opposed to the photoreceptor drum 10. A conventionally known pre-charging process, image exposing process, and developing process have been stated above.

The CPU 80 selects the transfer sheet $P_{1n}$ loaded in the sheet feed cassette 41 according to the designated size of the transfer sheet and to the designated magnification. Thereby, step 10 is conducted using the sheet condition bin $PSB_{an}$. The CPU 80 drives the first sheet feed roller and the uppermost transfer sheet $P_{1n}$ is fed from the sheet feed cassette 41. The transfer sheet $P_{1n}$ passes through the sheet feed sensor PS1 and arrives at the second sheet feed roller 27. Thereby, a jamming timer $TK_{J1}$ carries out an increment of the operation clock. Next, the transfer sheet $P_{1n}$ is fed onto the photoreceptor drum 10 by the second sheet feed roller 27 which is synchronously operated with the toner image on the photoreceptor drum 10. The CPU 80 decreases the output voltage of the high voltage power source 70 when the base current of the transistor $70T_r$ is controlled by the CPU 80 according to the content "10" of the sheet condition bin $PSB_{al}$. Thereby, the transfer unit 52 discharges electric charges having a transfer current value which is smaller by 10 (μA) than the standard transfer current value of 180 (μA). The toner image on the photoreceptor drum 10 is transferred onto the transfer sheet $P_{1n}$, and the transfer sheet $P_{1n}$ is separated from the photoreceptor drum 10 by a charger 53. The transfer sheet $P_{1n}$, onto which the toner image has been transferred, is sent to the fixing unit 60 and sandwiched between a thermal fixing roller and a contact pressure roller. It is thermally fused, and then delivered outside the apparatus. At this time, the transfer sheet $P_{1n}$ passes through a sheet delivery sensor PS4. Then, the CPU 80 resets the jamming timer $TK_{J1}$ and stands by for the next output from the sheet feed sensor PS1. The CPU 80 shifts the content of the sheet condition bin $PSB_{an}$ by 1 and changes the content of the sheet condition bin to that shown by ① in Table 3. As described before, when the transfer sheet $P_{1n}$ is jammed, the shift operation of the sheet condition bin $PSB_{an}$ is not conducted. On the other hand, the CPU 80 drives the cleaning unit with the blade so that remaining toner on the photoreceptor drum 10 is scraped off, and then stands by for the next copy cycle. The above-mentioned is the control operation of the transfer current.

The relationship between a supplying operation of the transfer sheet and a counting operation of the time counters TK1, TK2, TK3, which correspond to a time counting means, will be described below.

When a message that the sheet feed cassette 41 is empty is displayed on a liquid crystal display provided on the operation panel 90, the operator takes the sheet feed cassette 41 off of the apparatus and supplies the transfer sheets. In this example, when the sheet feed cassette 41 is removed, the CPU 80 senses it, resets the time counter TK1 to "0", and stops the counting operation. After the package of transfer sheets has been opened and the transfer sheets have been supplied to the sheet feed cassette 41, the sheet feed cassette 41 is loaded into the apparatus. The CPU 80 senses this loading, and carries out an increment of the time counter TK1. Because of the above-described operations, the CPU 80 starts counting the time elapsed after the package of transfer sheets has been opened. The time counters TK2 and TK3 corresponding to the sheet feed cassettes 42 and 43 to which the supplying operation has not been conducted, continue to carry out the increment. (S11, S12) Here, only the supplying operation of the sheet feed cassette 41 has been explained. However, the supplying operation of sheet feed cassettes 42 and 43 is the same as that of the sheet feed cassette 41.

Finally, after-processing in the high voltage power source control program is described as follows:

When the CPU 80 senses the deactivation operation of the power switch (S13), the CPU 80 stops the increment operation of all time counters TKM, TK1, TK2, and TK3. Then, the CPU 80 writes the increment values of the time counters TK1, TK2, TK3 in a predetermined memory area in the non-volatile RAM 81 (S14). Successively, the CPU 80 writes the humidity data stored in the humidity memories HSM1, HSM2, and HSM3 in a predetermined memory area in the non-volatile RAM 81 (S15). The CPU 80 writes the temperature data into which the output voltage sent from the temperature sensor TS is decoded with 256 gradation, in a predetermined memory area in the non-volatile RAM 81 (S16). Then, the CPU 80 returns to the main routine and stops control operations.

As described above, according to the control method of the high voltage power source 70 in this example, when only the humidity is measured, the elapsed time after the package of the transfer sheets $P_{1n}$ has been opened, is calculated and the moisture content of the transfer sheet $P_{1n}$ can be estimated. When the transfer current is adjusted according to the correlation between the assumed moisture content and the surface resistance of the transfer sheet $P_{1n}$, the toner smear phenomenon and the imperfect transfer phenomenon can be prevented. Accordingly, the transfer sheet performance and the sheet feed performance can be improved. As described above, since a new structure is not added to the sheet supplying system, there is no possibility of imperfect transfer and imperfect separation.

Further, according to the control method of the high voltage power source 70 in this example, since the transfer current is controlled by the time lag between the humidity and the moisture content due to the loading sequence of the transfer sheets $P_{1n}$, $P_{2n}$, $P_{3n}$, a process condition for every transfer sheet can be optimized.

Further, in the control method of the high voltage power source 70 in this example, a timer used for the power source deactivation time is not necessary. Accordingly, this control method is suitable for a printer or a smaller copier in which a back-up power source is not provided for economical reasons, and in which on/off operations of the power source are frequently conducted.

According to the present invention, in an image forming apparatus in which process conditions related to a sheet feeding system are adjusted according to output signals from moisture sensors, a control circuit is provided with the following: an off-time estimation means for assuming a power source deactivation period according to the surface temperature of the fixing roller and heat radiation elapsed time characteristics of the fixing roller; a time counting means for counting the time elapsed after a sheet feed cassette has been loaded; and a moisture content conversion means for converting the total time after the sheet feed cassette loading and the humidity into the moisture content of transfer sheets. When the control circuit controls an output from a high voltage power source, the structure and control method of the sheet feeding system are not complicated, and a control method of the high voltage power source in relation to the moisture content of the transfer sheet can be realized.

Further, when a memory means, into which humidity data at the time of power source deactivation, surface temperature data of the fixing roller, and a total time elapsed after the sheet feed cassette loading are written, is provided to the control circuit, the control method of the present invention can be applied to a printer or a smaller copier in which an internal timer for counting the power source deactivation time can not be provided.

Further, other than the foregoing means, in the image forming apparatus, when the control circuit is provided with the following: a loading sequence detection means for detecting the loading sequence of transfer sheets loaded in the sheet feed cassette at the time of power source activation; and a time lag correction means for correcting the time lag between the humidity and the moisture content due to the loading sequence of the transfer sheets, since the transfer current is controlled by the time lag between the humidity and the moisture content due to the loading sequence of the transfer sheets, a process condition for every transfer sheet can be optimized.

Further, other than the foregoing means, in the image forming apparatus, when the control circuit is provided with: a sheet condition detection means for detecting whether the transfer sheet is under the moisture absorption condition or under the moisture radiation condition from the humidity data at the time of power source activation, and the humidity data at the time of the power source deactivation; a moisture content conversion means when the transfer sheet is under the moisture absorption condition; and a moisture content conversion means when the transfer sheet is under the moisture radiation condition, suitable process conditions can be obtained under any of the moisture absorption condition or the moisture radiation condition of transfer sheets.

What is claimed is:

1. An image forming apparatus comprising:

a high voltage power source;

a plurality of sheet storing cassettes for storing recording sheets therein;

a moisture sensor for sensing moisture;

transfer means for transferring an image to the recording sheets by applying transfer current generated at the high voltage power source;

cut-off period estimating means for estimating a cut-off period of the high voltage power source based on a combination of surface temperature of a fixing roller and heat radiation of said fixing roller during an elapsed time period;

measuring means for measuring an elapsed time period after one of said sheet storing cassettes is mounted onto said apparatus;

moisture content conversion means for converting the moisture sensed by said moisture sensor and said elapsed time period into moisture content data; and a control circuit for controlling an output of said high voltage power source based on said moisture content data.

2. The image forming apparatus of claim 1, wherein said moisture sensor is provided in a part of said apparatus.

3. The image forming apparatus of claim 2, wherein said part of said apparatus is adjacent said one of said sheet storing cassettes.

4. The image forming apparatus of claim 1, further comprising memory for storing data of the moisture sensed by the moisture sensor, data of the surface temperature of the fixing roller when said power source is cut-off, and data of the total period of time after said one of said cassettes is mounted onto said apparatus.

5. The image forming apparatus of claim 1, wherein said control circuit further comprises:

stacking order detection means for detecting a stacking order of each recording sheet stacked in said one of said sheet storing cassettes when said power source is turned on; and time lag compensation means for compensating for a time lag of moisture and moisture content of the recording sheets according to the stacking order.

6. The image forming apparatus of claim 1, wherein said control circuit further comprises:

sheet state discrimination means for discriminating between a moisture absorption state and a moisture radiation state of the recording sheets stacked in said one of said sheet storing cassettes based on moisture data when said power source is turned on and turn off, first moisture content conversion means for converting moisture of the recording sheets in said moisture absorption state; and second moisture content conversion means for converting moisture of the recording sheets in said moisture radiation state.

* * * * *